United States Patent [19]

Matsumura et al.

[11] Patent Number: 4,941,450

[45] Date of Patent: Jul. 17, 1990

[54] IGNITION DISTRIBUTOR FOR AN INTERNAL COMBUSTION ENGINE

[75] Inventors: Masami Matsumura; Masayuki Ikeuchi; Shinichi Nobuto, all of Hyogo, Japan

[73] Assignee: Mitsubishi Denki Kabushiki Kaisha, Tokyo, Japan

[21] Appl. No.: 167,092

[22] Filed: Mar. 11, 1988

[30] Foreign Application Priority Data

Mar. 13, 1987 [JP] Japan ..... 62-37714[U]

[51] Int. Cl.[5] ..... F02P 7/03

[52] U.S. Cl. ..... 123/633; 123/647; 123/146.5 A

[58] Field of Search ..... 123/633, 647, 146.5 A

[56] References Cited

U.S. PATENT DOCUMENTS 4,562,813 1/1986 Okado et al. ..... 123/647

FOREIGN PATENT DOCUMENTS 52-56234 5/1977 Japan ..... 123/633
57-173567 10/1982 Japan ..... 123/647
59-185876 10/1984 Japan ..... 123/146.5 A

*Primary Examiner*—Andrew M. Dolinar
*Attorney, Agent, or Firm*—Lowe,Price,LeBlanc,Becker & Shur

[57] ABSTRACT

An ignition distributor for an internal combustion engine comprises a cylindrical distributor rotor of synthetic resin that rotated synchronously with the revolution of the engine, a rotor electrode radially and outwardly extending from the central portion on an upper surface of the rotor, a plurality of circumferential electrodes disposed in the rotating locus of said rotor and separated from said rotor electrode by a discharge gap, a contact electrode contacting said rotor electrode, a rotation angle sensor, and a signal processing unit for processing output signal from the rotation angle sensor. The signal processing unit is arranged coaxially with and below the distributor rotor, and is provided with a shield cover which is earthed.

6 Claims, 2 Drawing Sheets

IGNITION DISTRIBUTOR FOR AN INTERNAL COMBUSTION ENGINE

FIELD OF THE INVENTION

This invention relates to an ignition distributor for an internal combustion engine and, in particular, to a distributor with a shielded signal processing unit housed therein for suppressing radio frequency interference or radio noise (hereinafter referred to as RFI) which is generated between a rotor electrode and respective circumferential electrodes.

BACKGROUND OF THE INVENTION

The conventional distributor for an internal combustion engine is shown in FIG. 1. A distributor housing 10 mounted in an internal combustion engine (not shown) consists of two portions, namely an upper distributor housing portion 11 and a lower shaft-bearing portion 12. The lower portion 12 has a cylindrical shape and has an axial bore 13 in which a rotary shaft 14 is inserted and supported at the upper end by a bearing member 15 and at the lower end by a metal sleeve 16. The rotary shaft 14 at the upper end is integrally connected with a bushing 17 upwardly extending axially of an enlarged space 18 in the upper portion 11 of the housing 10. The upper portion 11 at its upper end is engaged with and closed by a cap 19 secured to the housing 10 by screws 20. The bushing 17 has a rotary disc 21 secured vertically divided between upper and lower parts 17*a*, 17*b* fixed by a screw 22.

The rotary disc 21 extends radially and outwardly of the bushing 17. The bushing 17 at its top end is connected with a distributor rotor 23 which is secured by inserting the upper end of the bushing 17 into a bore provided in the distributor rotor 23 and fixed by a screw 24. The distributor rotor 23 is made of synthetic resin and at its upper surface has a rotor electrode 25. The rotor electrode 25 at one end is positioned about the rotating axis of the rotor 23 and is slidably connected with a contact 26 provided at the lower end of a central electrode 27, which is arranged in alignment of the rotary axis of the distributor rotor 23 and secured in a bore provided in the top wall of the cap 19. The electrode 25 at its other and outer end moves and passes near the side wall of the cap 19 and, successively, a plurality of circumferential electrodes 28 with a discharge gap. The circumferential electrodes 28 are positioned about the central electrode 27 circumferentially of the top wall of the cap 19 and spaced one to the other with a predetermined angular interval.

The shaft 14 is rotated synchronously with the revolution of the internal combustion engine and rotates the disc 21 integrally therewith. The disc 21 has a radial slit at a position at which it faces to a photoelectric pickup. The photoelectric pickup consists of a light-emitting element 29 and a light-receiving element 30 which are arranged opposite to each other with respect to a symmetric plane containing the rotary disc 21. The unit 31 including the light-emitting and light-receiving elements 29, 30 has also a signal processing circuit 32 for processing output signal from the photoelectric pickup. 31*a* is an element that acts to protect the unit from radio frequency interference (RFI).

In the above-mentioned apparatus, the shaft 14 rotates synchronously with the revolution of the engine (not shown). In the rotation of the shaft 14, the slit in the rotary disc 21 crosses an infrared light beam and intermittently passes it between the light-emitting element 29 and the light-receiving element 30. The corresponding output signal from the light-receiving element 30 is processed for its wave-form shaping and the like by signal processing circuit 32, thereby to obtain a predetermined crank angle signal or cylinder discriminating reference signal. Such a signal determines ignition time when the ignition high voltage is supplied to the central electrode 27 from where it is successively distributed to the plurality of circumferential electrodes 28 through the contact 26 and the rotor electrode 25 so that ignition is provided in each cylinder of the internal combustion engine (not shown).

In a conventional distributor as described above, however, electrical noise from outside is induced into the signal processing circuit 32. This may cause operational errors, in particular erroneous ignition and missing ignition of the internal combustion engine.

As the result of careful investigation on this problem, the following cause therefor has been found. When the center electrode 27 is supplied with ignition high voltage, this voltage is induced to the distributor rotor 23, the bushing 17 and the shaft 14. Usually the shaft 14 is connected with the housing 10 for grounding thereof. However, at the motion transmitting portion at the bearing 15 and between the shaft 14 and the sleeve metal 16, there can exist some clearance or gap which may cause the the shaft to lose contact with its electrical ground, i.e., to be temporarily ungrounded during high acceleration or deceleration of the engine. A high voltage which is induced to the bushing 17, the shaft 14, etc., in this state is also induced to the signal processing circuit 32 and may cause errors in its operation.

SUMMARY OF THE INVENTION

It is accordingly an object to the present inventon to provide an ignition distributor for an internal combustion engine with a signal processing unit housed therein, which is highly reliable due to elimination of operational errors. The object of the present invention is attained by providing the signal processing unit with a shield cover and by grounding the cover.

BRIEF DESCRIPTION OF THE DRAWINGS

The present invention will be more apparent from the ensuing description with reference to the accompanying drawings wherein.

The same reference numerals indicate identical or corresponding parts in both figures.

DESCRIPTION OF THE PREFERRED EMBODIMENT

Figure 1:
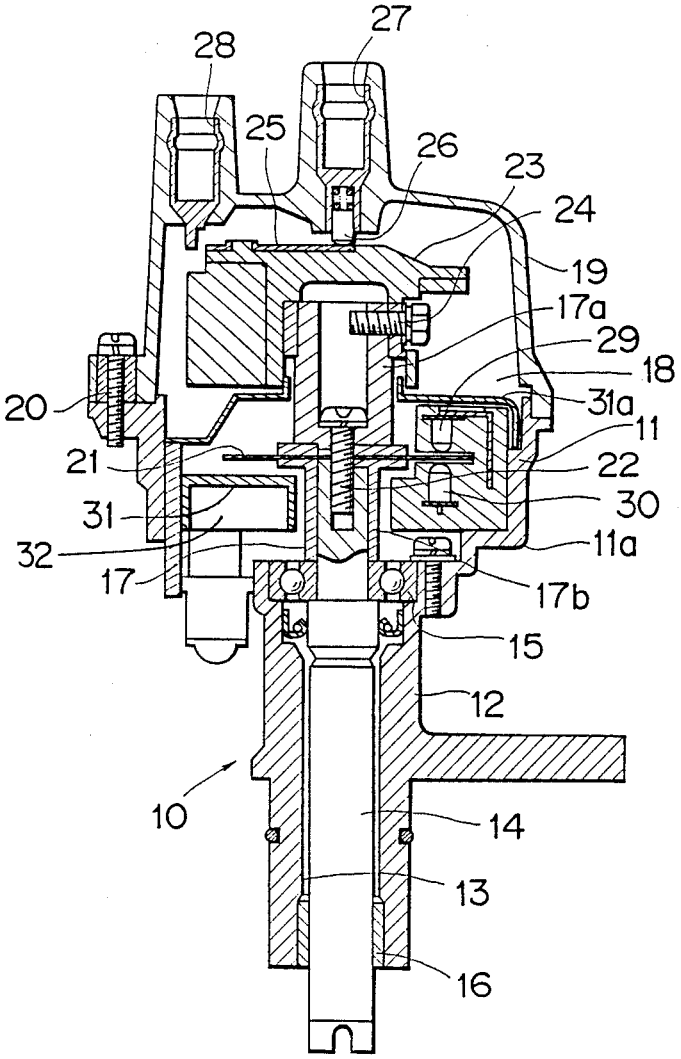
FIG. 1 PRIOR ART
FIG. 1 shows an axial section view of a conventional distributor for an internal combustion engine.
Figure 2:
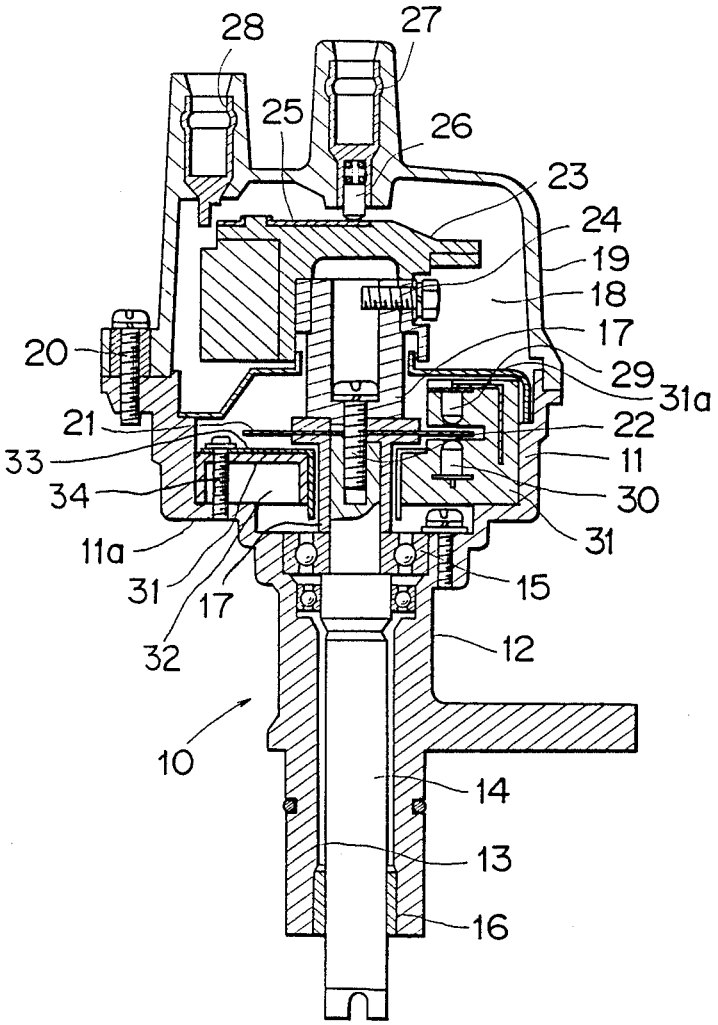
FIG. 2 shows a similar view of a distributor incorporating a shielded signal processing unit according to this invention.

A preferred embodiment of a distributor for an internal combustion engine according to the present invention will now be described with reference to FIG. 2. In FIG. 2, showing the structure of the distributor according to this invention, a unit 31 provided with a signal processing circuit 32 housed therein is enclosed in the interior of the upper and enlarged part 11 of the housing 10. The unit 31 is positioned outwardly of the bushing 17 and is spaced therefrom with a predetermined clearance and is supported on a stepped and annular shoulder 11*a* with an outer or circumferential surface being in contact with the inner wall of the enlarged housing part 11. The upper surfaces of annular segment and inner tubular surface of the unit 31 are protected by a shield cover 33 of electrically conductive material. A screw 34 is inserted into aligned bores provided in the cover 33, the unit 31 and housing wall, and fixedly mounts the unit 31 together with the cover 33 to the housing 10. The screw 34 also serves to earth the cover 33 through the housing 10.

As the unit 31 is thus shielded by the cover 33 on the upper surface as well as on its inner cylindrical surface from the bushing 17, undesired high voltage induced in the bushing 17 does not affect the signal processing circuit 32 so that it is prevented from suffering operational errors.

In the embodiment as exemplified in the drawings, the unit 31 is positioned opposite to the bushing 17. However it is the same when the unit 31 is placed opposite to the shaft 14. According to this invention, the rotary shaft may include not only the shaft 14, but also the bushing 17.

When constructed as above, the signal processing unit 31 is shielded by the cover 33, radially and inwardly from the bushing 17 or any other rotary member and upwardly from any high voltage inducing member, so that a highly reliable engine ignition distributor incurring no operational errors can be provided.

What is claimed is:

1. An ignition distributor for an internal combustion engine, comprising:

a cylindrical distributor rotor comprising a synthetic resin that is mounted on a bushing rotated synchronously with the revolution of the engine;

a rotor electrode radially and outwardly extending from the central portion on an upper surface of the distributor rotor;

a plurality of circumferentially disposed electrodes in the rotating locus of said distributor rotor and separated from said rotor electrode by a discharge gap;

a contact electrode contacting said rotor electrode;

a rotation angle sensor; and a signal processing unit for processing said output signal from the rotation angle sensor, the signal processing unit being arranged coaxially with and below the distributor rotor, characterized in that the signal processing unit is mounted directly to the distributor housing and is provided with a grounded electrically conductive shield cover mounted to the signal processing unit.

2. An ignition distributor as claimed in claim 1, wherein:

the shield cover for the signal processing unit covers the unit on an upper wall and an internal cylindrical wall thereof.

3. An ignition distributor as claimed in claim 1, wherein:

the signal processing unit is positioned opposite to the bushing supporting the distributor rotor.

4. An ignition distributor as claimed in claim 1, wherein:

the shield cover is grounded by connection with the housing of the ignition distributor.

5. An ignition distributor for an internal combustion engine, comprising:

a cylindrical distributor rotor comprising a synthetic resin and rotated synchronously with the revolution of the engine;

a rotor electrode radially and outwardly extending from the central portion on an upper surface of the distributor rotor;

a plurality of circumferentially disposed electrodes in the rotating locus of said distributor rotor and separated from said rotor electrode by a discharge gap;

a contact electrode contacting said rotor electrode;

a rotation angle sensor; and a signal processing unit for processing output signal from the rotation angle sensor, the signal processing unit being arranged coaxially with and below the distributor rotor, characterized in that the signal processing unit is provided with a shield cover which is grounded by a screw which is inserted into alignment bores provided therefor in the shield cover, the signal processing unit and a housing wall of the distributor and integrally fixes them.

6. An ignition distributor as claimed in claim 5, wherein:

the screw also serves to ground the shield cover through the distributor housing.

* * * * *